US005887503A

United States Patent [19]

Kataigi et al.

[11] Patent Number: 5,887,503

[45] Date of Patent: Mar. 30, 1999

[54] SHEET CONVEYING DEVICE

[75] Inventors: Tsutomu Kataigi; Masayoshi Ochi; Motohiko Inoue, all of Tokyo, Japan

[73] Assignee: Juki Corporation, Tokyo, Japan

[21] Appl. No.: 814,895

[22] Filed: Mar. 12, 1997

Related U.S. Application Data

[63] Continuation of Ser. No. 412,416, Mar. 28, 1995, abandoned.

[30] Foreign Application Priority Data

Apr. 5, 1994 [JP] Japan ..... 6-093101

[51] Int. Cl.[6] ..... B31B 1/16; B26D 7/06

[52] U.S. Cl. ..... 83/106; 83/107; 83/155; 83/408

[58] Field of Search ..... 83/155, 107, 408, 83/106, 105

[56] References Cited

U.S. PATENT DOCUMENTS

| | | | |
|---|---|---|---|
| 3,264,917 | 8/1966 | Califano et al. | 83/106 |
| 3,693,486 | 9/1972 | Maniaci et al. | 83/107 |
| 3,988,983 | 11/1976 | Matsumoto et al. | 83/408 |
| 4,083,277 | 4/1978 | Lotz | 83/106 |
| 4,265,152 | 5/1981 | Corradi | 83/106 |
| 4,381,107 | 4/1983 | Armiger | 270/58 |
| 4,968,014 | 11/1990 | Yamakaoshi et al. | 83/106 |
| 5,125,303 | 6/1992 | Hoyland | 83/155 |
| 5,235,883 | 8/1993 | Jeske et al. | 83/107 |
| 5,397,106 | 3/1995 | Hill | 83/408 |

FOREIGN PATENT DOCUMENTS

| | | | |
|---|---|---|---|
| 41-9129 | 5/1966 | Japan | 83/106 |
| 651 526 | 9/1985 | Switzerland . | |

*Primary Examiner*—M. Rachuba
*Assistant Examiner*—Sean A. Pryor
*Attorney, Agent, or Firm*—McCormick, Paulding & Huber

[57] ABSTRACT

A sheet conveying device of the type including a supplying unit for supplying a plurality of sheets in side-by-side arrangement with respect to the sheet supplying direction, and a conveying unit for conveying the plurality of sheets being supplied from the supplying unit in a direction perpendicular to the sheet supplying direction to a desired working unit, in which, there is provided between the supplying unit and the conveying unit a selective conveying unit for selectively and independently conveying respective sheet to the desired working unit.

6 Claims, 9 Drawing Sheets

*Fig. 4*

| POSITION OF SHEET | 3 SHEET EXIST IN LEFT AND RIGHT | | | | | | | | | | | |
|---|---|---|---|---|---|---|---|---|---|---|---|---|
| FIXED DIVERT | 0 NONE | | | | 1 LEFT | | | | 2 RIGHT | | | |
| OMR DIVERT | | | | | | | | | | | | |
| CONVEYING ORDER | 0 | 1 | 2 | 3 | 0 | 1 | 2 | 3 | 0 | 1 | 2 | 3 |
| DIRECTION OF SYSTEM: 0 LEFT, 0 LEFT | BOTH | LEFT | BOTH | LEFT | LEFT | LEFT | LEFT | LEFT | BOTH | LEFT | BOTH | LEFT |
| DIRECTION OF SYSTEM: 0 LEFT, 1 RIGHT | RIGHT | RIGHT | BOTH | BOTH | RIGHT | RIGHT | BOTH | BOTH | BOTH | BOTH | BOTH | BOTH |
| DIRECTION OF SYSTEM: 1 RIGHT, 0 LEFT | LEFT | BOTH | LEFT | BOTH | BOTH | BOTH | BOTH | BOTH | RIGHT | BOTH | LEFT | BOTH |
| DIRECTION OF SYSTEM: 1 RIGHT, 1 RIGHT | BOTH | BOTH | RIGHT | RIGHT | BOTH | BOTH | RIGHT | RIGHT | RIGHT | RIGHT | RIGHT | RIGHT |

(1)
START
(2)
OPERABLE ?
N
Y
ERROR CONDITION
(3)
(4)
PRESENCE OF SINGLE SHEET ?
Y
N
(6)
ONE SHEET ?
N
Y
(5)
SHEET CUTTING
(8)
(7)
CONVEYING THE SHEET
CONVEYING ORDER TABLE DETERMINATION
CONVEYING THE SHEET
(9)
(10)
ERROR ?
Y
N
(12)
TRANSFER OR DIVERT SHEET TO DOWN STREAM UNIT
(13)
ERROR ?
Y
N
ERROR CONDITION
(11)
STOP KEY ?
(14)
STOP
(15)

SHEET CONVEYING DEVICE

This is a continuation of application Ser. No. 08/412,416 filed on Mar. 28, 1995 now abandoned.

TECHNICAL FIELD

This invention relates to a sheet conveying device and, particularly, a sheet conveying device of the type comprising a conveying unit for conveying a plurality of sheets being supplied from a supplying unit in a side-by-side arrangement to a desired working unit.

BACKGROUND ART

A sheet conveying device of the type including a supplying unit for supplying a plurality of sheets in a side-by-side arrangement with respect to the sheet supplying direction, and a conveying unit for conveying the plurality of sheets being supplied from the supplying unit in a direction perpendicular to the sheet supplying direction to a desired working unit is known to the public. For example, in a mail enclosing and sealing device of a mail processing apparatus, a first perpendicular conveying unit is disposed on the sheet delivery side of a cutter unit acting as a delivery unit, and on the delivery side of the first perpendicular conveying unit there is provided a working unit such as an enclosing unit through a second perpendicular conveying unit.

A continuous document paper is cut suitably by a cutter unit to make two or more single document sheets, and a respective single sheet is delivered toward the first perpendicular conveying unit with the respective single sheet being arranged side by side in a direction perpendicular to the conveying direction. The respective single sheet being received by the first conveying unit is delivered toward the second conveying unit and in the direction perpendicular to the prior conveying direction and, at that time, the sheet located closest to the second conveying unit is firstly conveyed onto the second conveying unit and, thereafter, the sheet located second closest to the second conveying unit is conveyed onto the second conveying unit.

In such a prior art sheet conveying device, it is impossible to change the order of conveying the sheet onto the second conveying unit. In particular, the sheet delivered closest to the side of the second conveying unit is firstly conveyed, and the sheet delivered next closest to the second conveying unit is conveyed thereafter. Thus, when it is desired to convey the sheet not located closest to second conveying unit first, it is required to change the location of the second conveying unit with respect to the first conveying unit, or to undertake some other process such as excluding the sheet not desired to be convey first from the conveying path. Further, it is difficult to arrange a diverting device and the like to exclude the sheet on one side from the conveying path. Accordingly, there is a problem that the freedom in design is limited and, thus, it is difficult to modify the device to adapt to the needs of the user.

An object of the invention is to provide a sheet conveying device which permits changes in the sheet conveying order as desired, and which enables an increase in the freedom in design in the conveying process.

DISCLOSURE OF THE INVENTION

According to the present invention, there is provided a sheet conveying device of the type including a supply unit for supplying a plurality of sheets in a side-by-side arrangement with respect to the sheet supplying direction, and a conveying unit for conveying the plurality of sheets being supplied from the supplying unit in the direction perpendicular to the sheet supplying direction to a desired working unit, in which, there is provided between the supplying unit and the conveying unit a selective conveying unit for selectively and independently conveying respective sheets to the desired working unit.

According to the invention, when a plurality of sheets are supplied in a side-by-side arrangement with respect to the sheet supplying direction, the sheets are received by the selective conveying unit, which unit acts to convey each of the respective sheet in an independent predetermined direction, thus, it is possible to handle various sheets in a desired manner.

BRIEF DESCRIPTION OF THE DRAWINGS

Further objects and advantages of the present invention will become apparent from the following detailed description given in conjunction with the attached drawings, in which:

FIG. 4 shows an example of an indicating table showing the conveying order utilized in the control device of FIG. 3;

Figure 8:
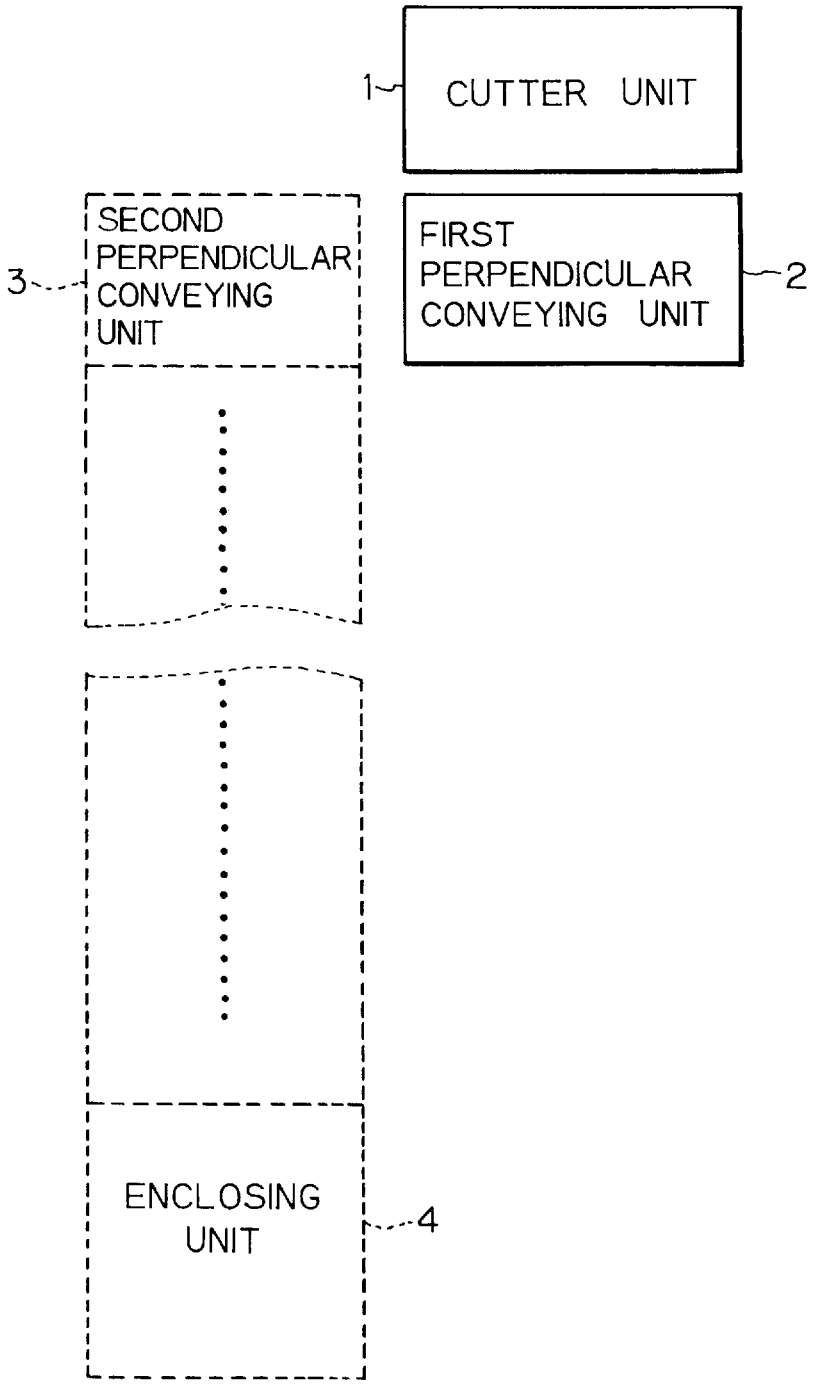
Fig. 8 PRIOR ART
FIG. 8 is an explanatory schematic plan view of a prior art sheet conveying device, and FIGS. 9(*a*) through 9(*d*) are explanatory plan views of an example of a prior art sheet conveying procedure.

BEST MODE FOR CARRYING OUT THE INVENTION:

FIG. 8 shows a typical prior art mail enclosing and sealing device of a mail processing apparatus, in which, a first perpendicular conveying unit 2 is disposed on sheet delivery side (lower side in the drawing) of a cutter unit 1 acting as a delivery unit, and on the delivery side (left side in the drawing) of the first perpendicular conveying unit 2, there is provided a working unit such as an enclosing unit 4 through a second perpendicular conveying unit 3.

Figure 9:
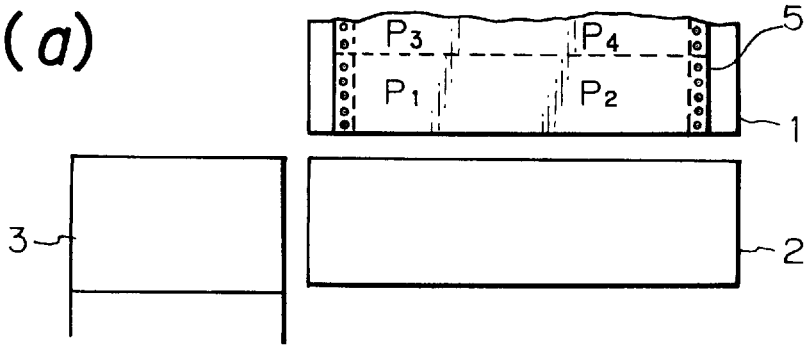
Fig. 9 (a) PRIOR ART
Figure 9:
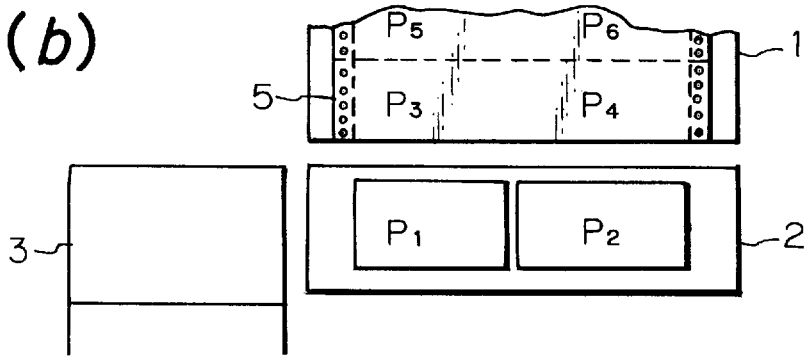
Fig. 9 (b) PRIOR ART
Figure 9:
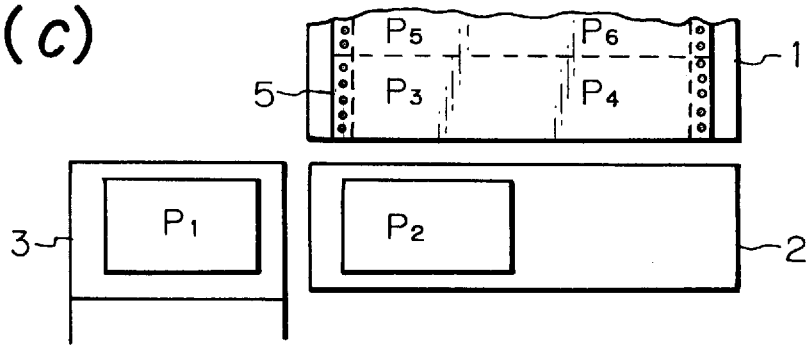
Fig. 9 (c) PRIOR ART
Figure 9:
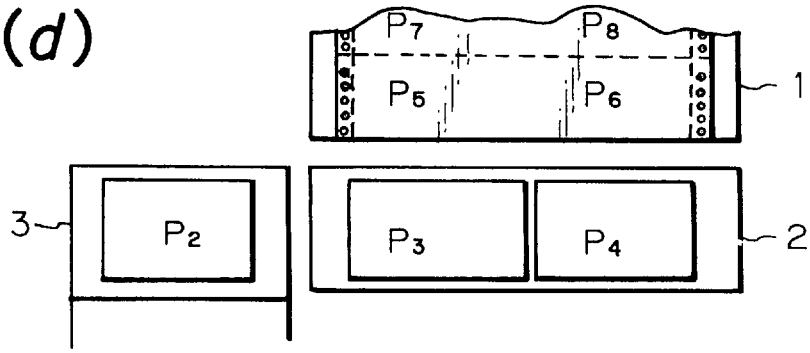
Fig. 9 (d) PRIOR ART

A continuous document paper 5 as shown in FIG. 9(*a*) is cut suitably by the cutter unit 1 to make two single document sheets $P_1$ and $P_2$ as shown in FIG. 9(*b*), and the two sheets $P_1$ and $P_2$ are delivered toward the first perpendicular conveying unit 2 with the two sheets being arranged side by side in a direction perpendicular (the left and right direction in the drawing) to the conveying direction. The two sheets $P_1$ and $P_2$ being received by the first perpendicular conveying unit 2 are delivered toward the second perpendicular conveying unit 3 and in a direction perpendicular to the prior conveying direction and, at that time, the sheet $P_1$ located near to the second perpendicular conveying unit 3 is first conveyed onto the second perpendicular conveying unit 3 as shown in FIG. 9(*c*) and, thereafter, the sheet $P_2$ is conveyed onto the second perpendicular conveying unit 3 as shown in FIG. 9(*d*).

In such a prior art sheet conveying device, it is impossible to change the order in which the sheets are conveyed onto the second conveying unit 3. In particular, the sheet $P_1$ delivered near to the side of the second conveying unit 3 is first conveyed and the sheet $P_2$ delivered remote from the second conveying unit 3 is conveyed thereafter. Thus, when it is desired to convey the sheet $P_2$ first, it is required to change the location of the second conveying unit 3 with respect to the first conveying unit 2. Further, it is difficult to arrange a diverting device and the like to exclude the sheet on one side from the conveying path. Accordingly, in such prior art device, there has been a problem that the freedom in design is limited.

The present invention will hereinafter be explained with respect to an example as applied on an enclosing and sealing device in a mail processing system.

Figure 1A:
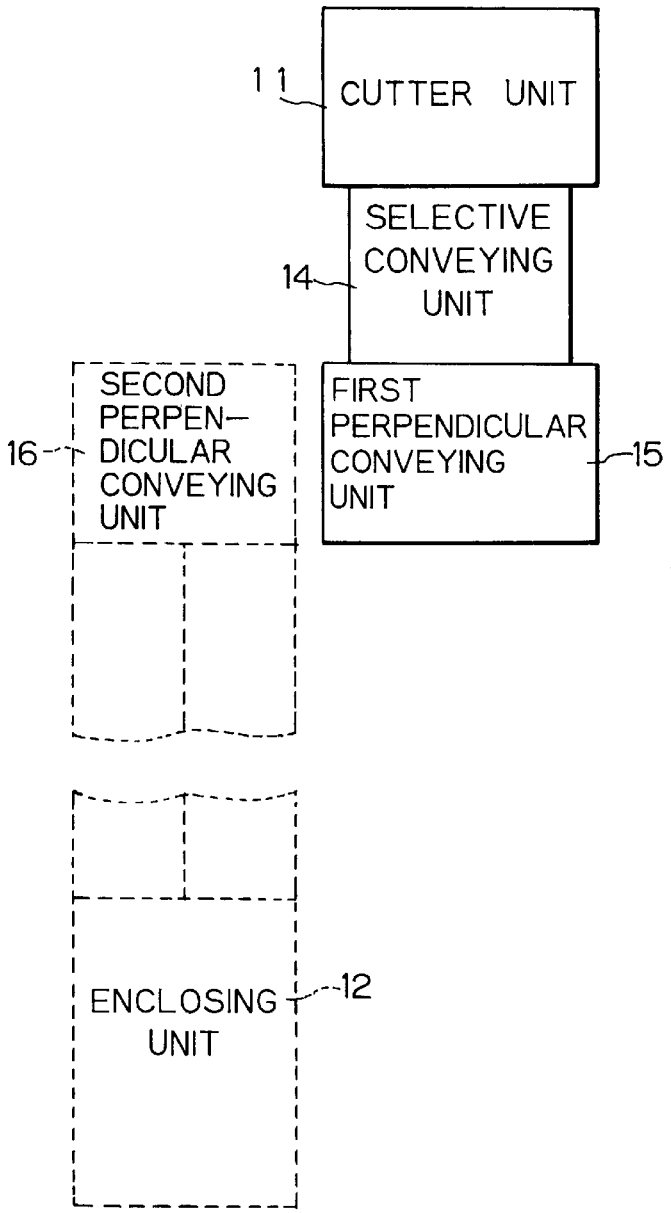
FIGS. 1(*a*) and 1(*b*) are schematic diagrammatic views of a sheet conveying device according to an embodiment of the present invention, with FIG. 1(*a*) being a schematic plan view and FIG. 1(*b*) a schematic plan view.
Figure 1B:
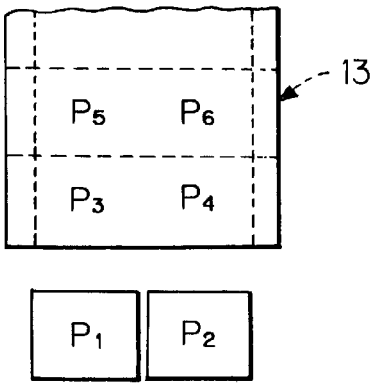

In FIG. 1(*a*) there is shown an embodiment of a sheet conveying device utilizing a cutter unit 11 acting as a sheet supplying unit, and the cutter unit 11 and an enclosing and sealing unit 12 acting as a working unit are connected through the sheet conveying device. The cutter unit 11 acts, as shown in FIG. 1(*b*), to cut suitably a continuous sheet 13 supplied into the cutter unit 11 to make two single sheets $P_1$ and $P_2$, and a selective conveying unit 14 is disposed on the sheet delivery side (lower side in the drawing) of the cutter unit 11. A first perpendicular conveying unit 15 is disposed on sheet delivery side (lower side in the drawing) of the selective conveying unit 14 and, on the delivery side (left side in the drawing) of the first perpendicular conveying unit 15, the working unit such as an enclosing unit 12 is connected through a second perpendicular conveying unit 16.

Figure 2:
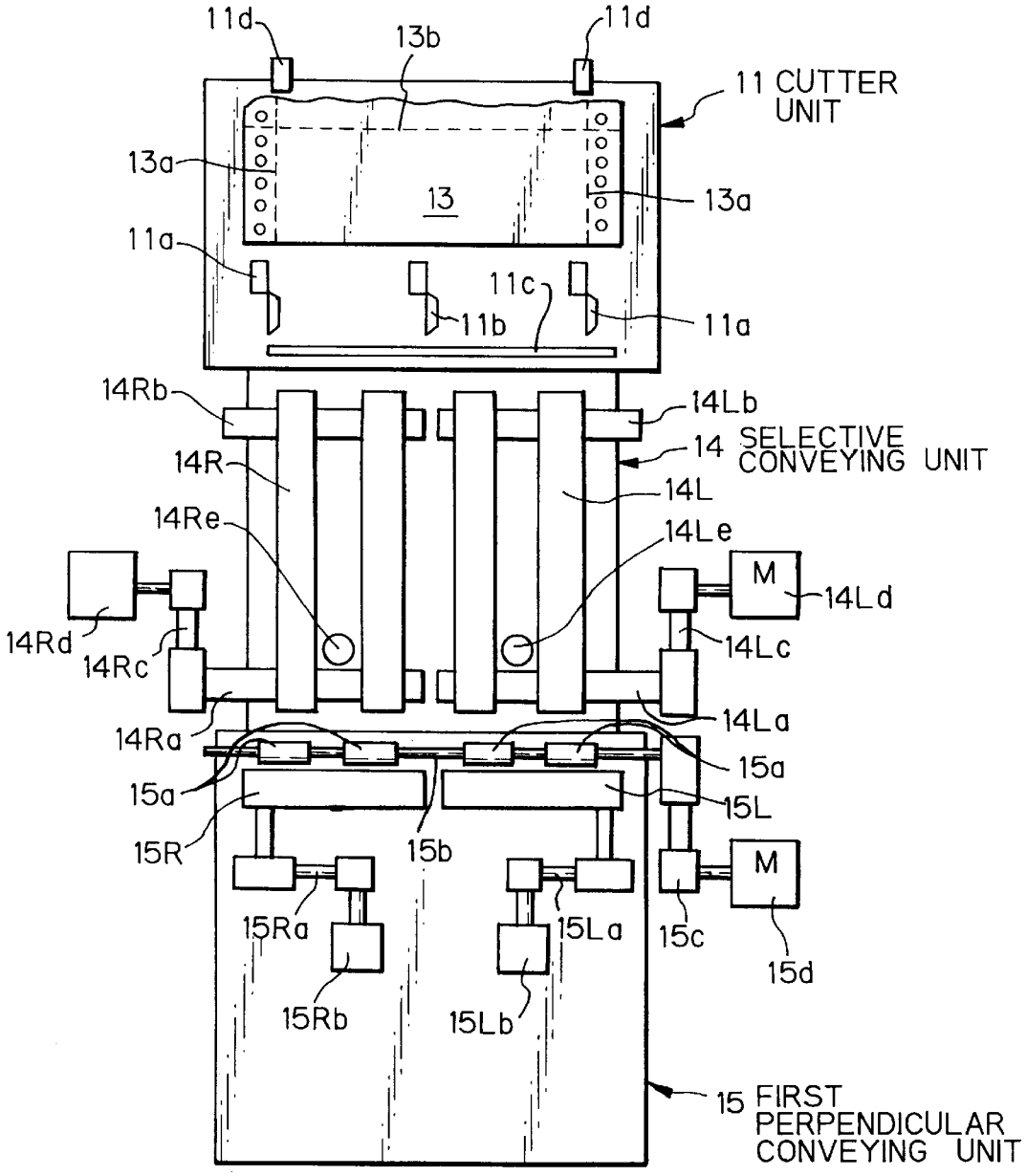
FIG. 2 is a schematic explanatory plan view of the essential portion of the sheet conveying device shown in FIGS. 1(*a*) and 1(*b*)

The cutter unit 11 includes, as shown in FIG. 2, a pair of side slitters 11*a* and 11*a* for cutting respectively a pair of perforations 13*a* and 13*a* provided in opposite widthwise edge portions of the continuous sheet 13, and a center slitter 11*b* for cutting the widthwise central portion of the continuous sheet 13. Further, a transverse cutter 11*c* is provided at the location just after the slitters 13*a* and 13*a* in the sheet conveying direction for cutting the perforations 13*b* defining respective sheet in the continuous sheet 13, and the cutter 11c extends along the entire length in the widthwise direction of the sheet 13.

Further, there are provided on the cutter unit 11, on the location corresponding the widthwise opposite edge portions of the continuous sheet 13, OMR sensors 11*d* and 11*d* for reading OMR marks provided on widthwise opposite edge portions of selected sheets in the continuous sheet 13. The OMR (Optical Marker Reader) marks direct, when attached to a specified sheet, to exclude or to OMR divert the specified sheet out of the conveying path.

The selective conveying unit 14 comprises a pair of conveying belts 14R and 14L being arranged parallel in the widthwise direction or in the direction perpendicular to the sheet conveying direction. Each of the conveying belts 14R and 14L is constituted of a pair of parallel belts being extending in the conveying direction and between drive shafts 14R*a* and 14L*a* in the downstream side of the conveying direction and driven shafts 14R*b* and 14L*b* in the upstream side of the conveying direction. The drive shafts 14R*a* and 14L*a* are connected respectively to drive motors 14R*d* and 14L*d* through suitable power transmitting mechanisms 14R*c* and 14L*c*. The drive motors 14R*d* and 14L*d* are driven independently and, thus, the conveying belts 14R and 14L act independently.

There are provided sheet check sensors 14R*e* and 14L*e* for checking the presence of the sheet on the conveying belts 14R and 14L in the downstream side (lower side in the drawing) of the selective conveying unit 14.

Further, a plurality of receiving rollers 15*a* for receiving sheet being conveyed from the selective conveying unit 14 are provided in the inlet side of the first perpendicular conveying unit 15 and, the rollers 15*a* are arranged in the widthwise direction of the sheet. The rollers 15*a* are secured to a shaft 15*b* and the shaft 15*b* is connected to a drive motor 15*d* through a suitable power transmitting mechanism 15*c*.

There are provided a pair of perpendicular conveying belts 15R and 15L at the location just after the receiving rollers 15*a* in the sheet conveying direction. The perpendicular conveying belts 15R and 15L extend respectively in the widthwise direction of the sheet, and the belts 15R and 15L are arranged such that adjacent edges of the belts face with each other at the widthwise central portion of the sheet. The perpendicular conveying belts 15R and 15L are connected respectively to drive motors 15R*b* and 15L*b* through suitable power transmitting mechanisms 15R*a* and 15L*a*, such that the perpendicular conveying belts 15R and 15L can be driven independently.

The operation of the conveying units 14 and 15 will now be explained.

Figure 3:
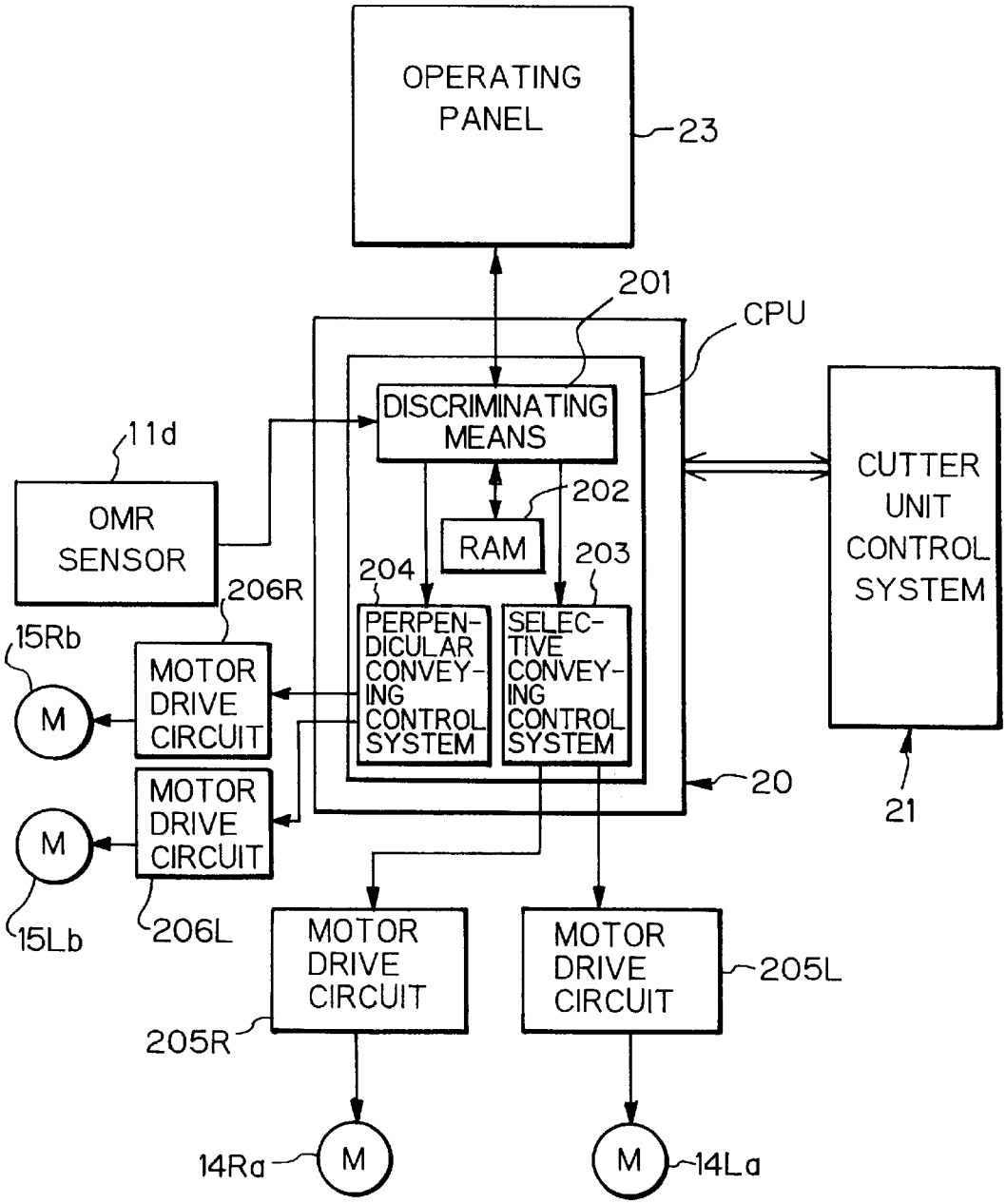
FIG. 3 is a block diagram showing an example of control device utilized in the sheet conveying device of FIGS. 1(*a*) and 1(*b*)

As shown in FIG. 3, a control device 20 of the conveying units 14 and 15 is connected to a control system 21 of the cutter unit 11 such that the conveying units 14 and 15 cooperate with the cutter unit 11 in conveying the sheet.

A central processing unit (described hereinafter simply as CPU) provided in the control device 20 of the conveying units 14 and 15 comprises a discriminating means 201 for receiving indicating input signal from an operating panel 23 and for receiving detection signal from the OMR sensor 11d and, the discriminating means 201 is connected to RAM 202 in which a conveying table (such as shown in FIG. 4) is received.

The operating panel 23 is provided for inputting sheet processing priority order conditions and for inputting the presence of divert excluding designated sheet from the sheet conveying passage. The conveying process as determined by the input signal from the operating panel 23 and by the detection signal from the OMR sensor lid is discriminated by the discriminating means 201, and corresponding conveying process is read from the RAM 202 so that a predetermined order will be issued to control portions 203 and 204 of respective conveying units.

In particular, the control portions 203 of the selective conveying unit 14 and the control portions 204 of the first perpendicular conveying unit 15 are connected to the discriminating means 201 such that predetermined order signal for a conveying operation is issued. The control portions 203 of the selective conveying unit 14 is connected with the drive circuits 205R and 205L of the drive motors 14R*d* and 14L*d*, and the control portions 204 of the first perpendicular conveying unit 15 is connected with the drive circuits 206R and 206L of the drive motors 15R*b* and 15L*b* respectively.

As shown in FIG. 4, it is described "Sheet Exist in Left and Right" in the column of "Position of Sheet" in the conveying table in the RAM 202, the sheet are normally exist in left and right sides in the widthwise direction according to the embodiment of the present invention. The "Fixed Divert" in the table shows whether the sheet designated by the input signal from the operating panel 23 should be excluded from the conveying path or not, the "OMR Divert" in the table shows whether the sheet attached thereon OMR mark based on the input signal from the OMR sensor 11*d* should be excluded from the conveying path or not, and the "Conveying Order" in the table shows the conveying order among a pair of sheets as indicated by the input signal from the operating panel 23. Further, the "Direction of System" in the table shows whether the second perpendicular conveying unit 16 is located on the left side or the right side of the first conveying unit 15 which is determined by the installation of the apparatus.

It will be understood that "Left" in the table shows that only the sheet of the left side as seen from the upstream side in the sheet conveying direction is conveyed, "Right" in the table shows that only the sheet of the right side as seen from the upstream side in the sheet conveying direction is conveyed, and "Both" in the table shows that both of the sheets of the left and right sides as seen from the upstream side in the sheet conveying direction are conveyed simultaneously.

Figure 5:
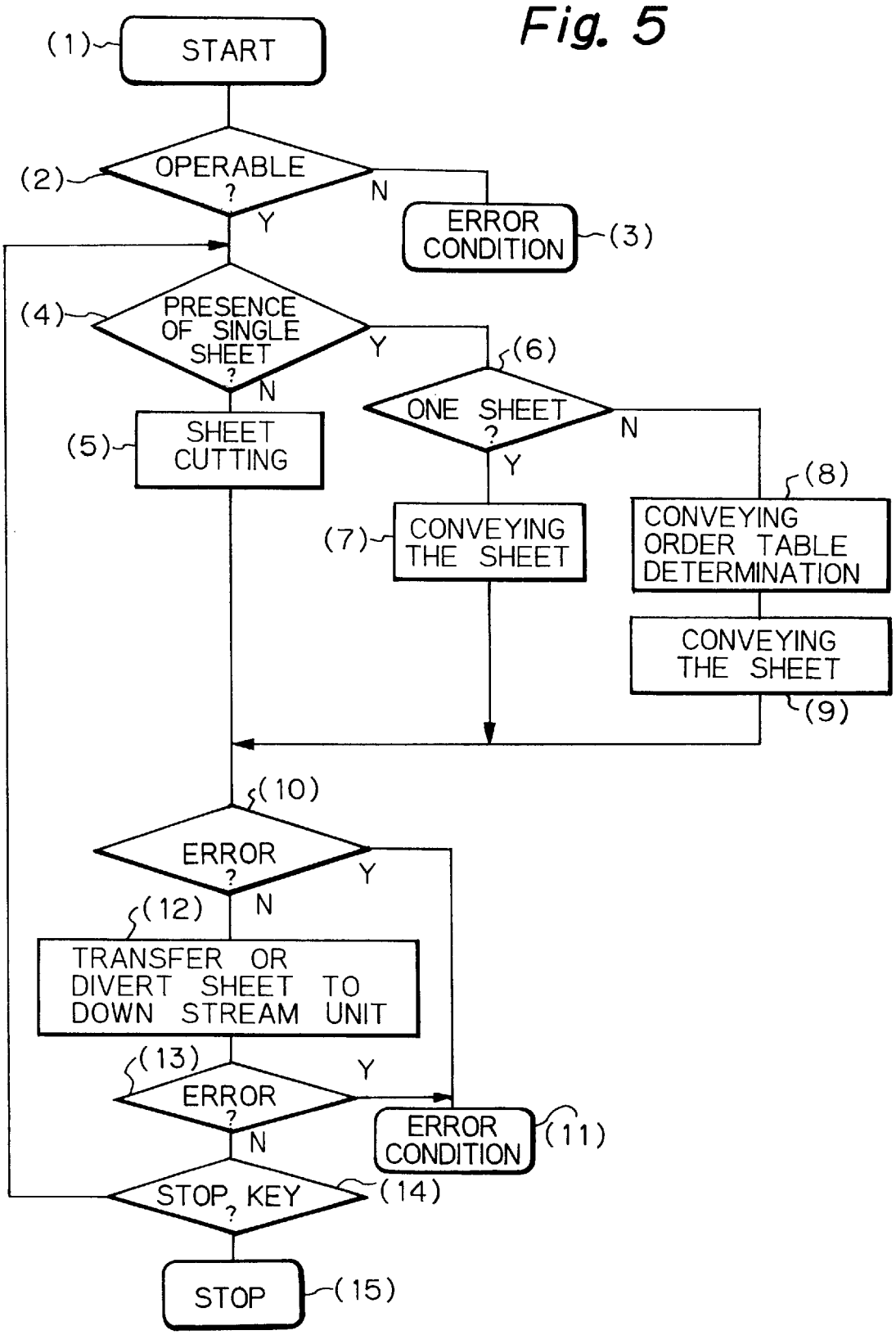
FIG. 5 shows a flow chart showing the sheet conveying procedure in the control device of FIG. 3.

The apparatus acts as shown in FIG. 5.

In FIG. 5, the-start key is pushed in the step (1), then, the operation of the whole enclosing and sealing system is started. In the step (2), the operable condition of the cutter unit 11 is checked and when an inoperable condition is found an error condition is indicated in the step (3) and the execution is interrupted. In the step (4), the presence of the single sheet being cut by the cutter unit 11 onto the conveying path of the selective conveying unit 14 is discriminated. When the sheet is not observed, the continuous sheet is cut in the step (5). At this step, two single sheets are cut from the continuous sheet.

When the sheet is observed in the conveying path of the selective conveying unit 14, the sheet is conveyed in the step (6). However, in the step (6), the number of the sheet on the sheet conveying path is firstly determined by the detection signal of the sheet check sensors 14R*e* and 14L*e*. When the number of the sheet is one, the sheet on the conveying path is conveyed to the first perpendicular conveying unit 14 on the downstream side in the step (7). When the number of the sheet is determined two in the step (6), the execution goes to the step (8), and the conveying order of the two sheets on the conveying path is determined. In particular, when two sheets are located on the conveying path, the conveying order is determined in accordance with the table shown in FIG. 4 and, the sheet are conveyed in the step (9).

In the step (10), the presence of the error condition is checked. When there is an error condition, the operation is interrupted in the step (11) and, when the error condition is not observed, the step (12) is executed to actuate the perpendicular conveying units 14 and 15, and the presence of the error condition is checked in the step (13). When there is an error condition, the operation is stopped. When the stop key is pushed in the step (14) the operation of the system is stopped at the step (15).

Embodical conveying operation will now be explained in conjunction with FIGS. 6 and 7.

Figure 7A:
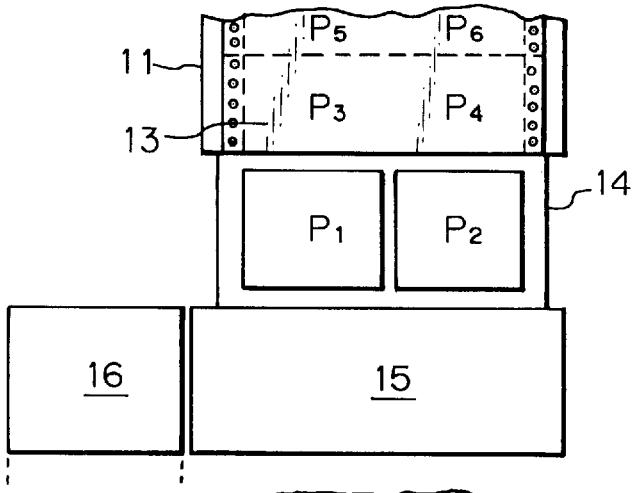
FIGS. 7(*a*) through 7(*c*) are explanatory plan views showing another example of the sheet conveying procedure.
Figure 7B:
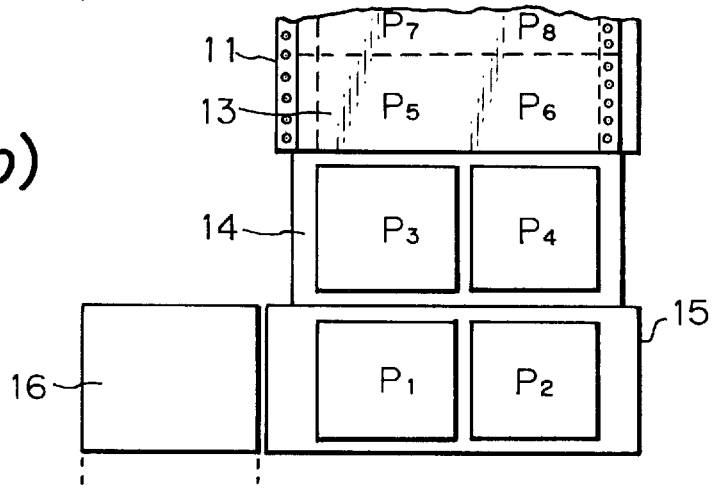
Figure 7C:
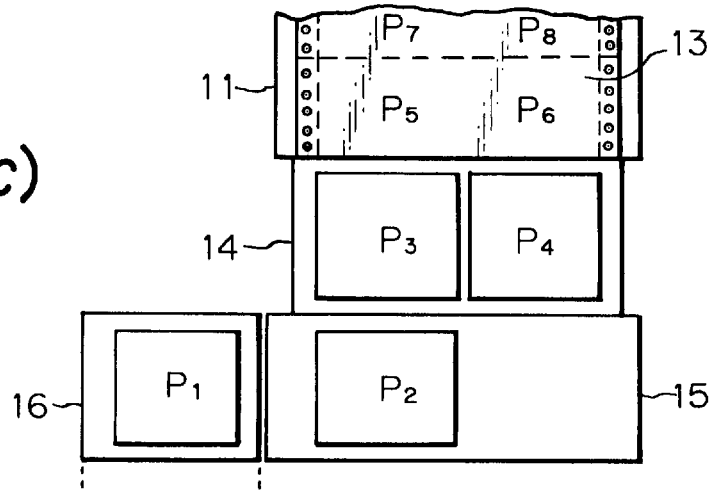

In the conveying operation shown in FIGS. 7(*a*) through 7(*c*), the continuous sheet 13 being supplied to the cutter unit 11, as shown in the step of FIG. 7(*a*), is cut into two sheets $P_1$ and $P_2$ as shown in the step of FIG. 7(*b*), and supplied to the selective conveying unit 14, and the two sheets are conveyed from the selective conveying unit 14 to the first perpendicular conveying unit 15. Simultaneously, the selective conveying unit 14 receives following two sheets $P_3$ and $P_4$ which have been cut by the cutter unit 11. In the step of FIG. 7(*c*), the sheet $P_1$ of one side is firstly conveyed by the first perpendicular conveying unit 15 toward the second perpendicular conveying unit 16 and, thereafter, the sheet $P_2$ is conveyed toward the second perpendicular conveying unit 16. It will be understood that the sheet $P_1$ is conveyed firstly, and the sheet $P_2$ is conveyed next in the conveying operation shown in FIGS. 7(*a*) through 7(*c*).

Figure 6:
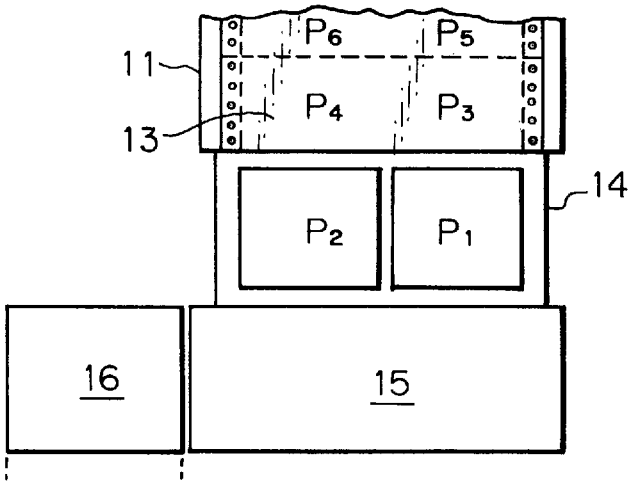
FIGS. 6(*a*) through 6(*c*) are explanatory plan views showing an example of the sheet conveying procedure.
Figure 6:
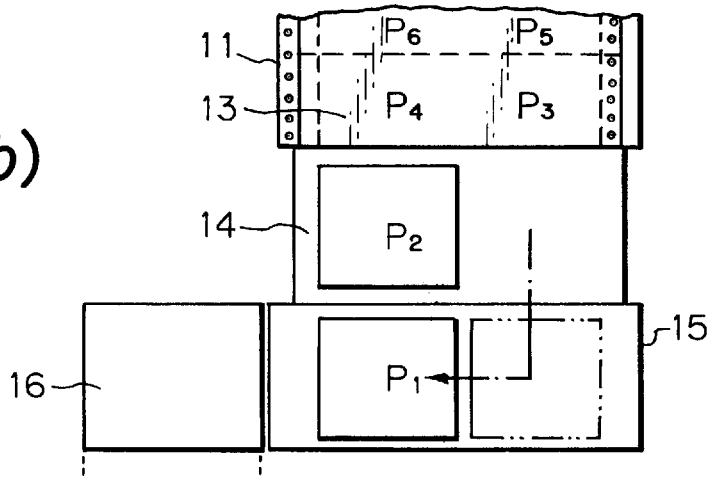
Figure 6:
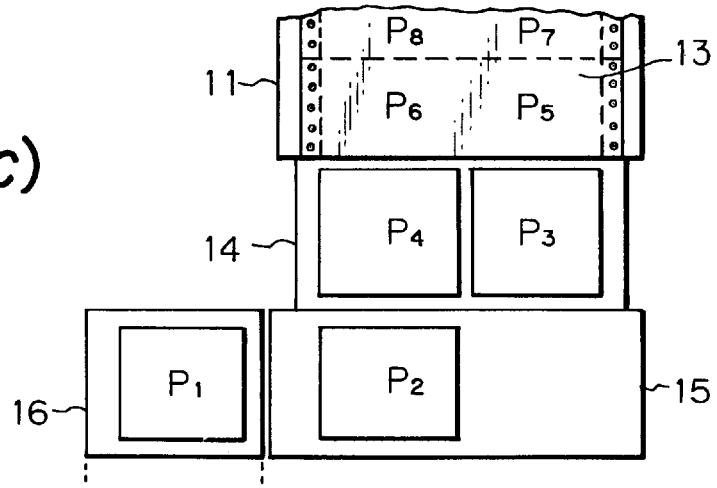

In the conveying operation shown in FIGS. 6(*a*) through 6(*c*), the sheet $P_1$ is conveyed and processed first, and the sheet $P_2$ is conveyed and processed thereafter, but, in this case, as shown in the step of FIG. 6(*a*), the location of the two sheets $P_1$ and $P_2$ being cut by the cutter unit 11 and conveyed onto the selective conveying unit 14 is opposite to that of FIGS. 7(*a*) through 7(*c*). Namely, in this case, as shown in the step of FIG. 6(*b*), the left side sheet $P_1$ as seen from the upstream side in the conveying direction is conveyed from the conveying belt 14L of the selective conveying unit 14 to the perpendicular conveying belt 15L of the first perpendicular conveying unit 15 and, then, the sheet P, is conveyed onto the second perpendicular conveying unit 16 by the perpendicular conveying belt 15L of the first perpendicular conveying unit 15. Thereafter, as shown in the step of FIG. 6(*c*), the sheets P2 is conveyed onto the perpendicular conveying belt 15R of the first perpendicular conveying unit 15 by the conveying belt 14R of the selective conveying unit 14. Then, the next continuous two sheets P3, P4 are cut and conveyed onto the selective conveying unit 14. Thus it will be understood that the sheet P1 is processed first onto the second perpendicular conveying unit 16, thereafter, the sheet P2 is processed onto the second perpendicular conveying unit 16.

As described heretofore, the conveying operation of the present invention is selectively performed according to the selective conveying table shown in FIG. 4, thus, it is possible to perform the conveying operation at various sequence by the same system and, further, it is possible to divert any desired sheet out of the processing path. When an OMR mark is attached the desired sheet, it is possible to perform OMR divert, in which, the OMR mark attached on the sheet is detected the sheet having the OMR mark thereon is diverted.

A preferred embodiment of the present invention has been explained as above, but the invention is not limited to the embodiment and, various changes and modifications may easily be made for those skilled in the art within the gist of the present invention.

The sheet conveying belt used in the sheet conveying units 14 and 15 may be substituted by any desired conveying means such as rollers and the like.

The cutter unit 11 may be substituted by any desired sending device which can send a plurality of sheets being arranged side-by-side with respect to the conveying direction.

Further, the present invention is not limited to handling continuous sheet and, it is possible to handle a plurality of sheets or two or more sheets of any desired types, and the working unit is not limited to the enclosing unit.

INDUSTRIAL APPLICABILITY

As described heretofore, the present invention is constituted of a supplying unit for supplying a plurality of sheets in side-by-side arrangement with respect to the sheet supplying direction, a conveying unit for conveying the plurality of sheets being supplied from the supplying unit in the direction perpendicular to the sheet supplying direction to a desired working unit, and a selective conveying unit for selectively and independently conveying respective sheet to the desired working unit, with the selective conveying unit being provided between the supplying unit and the conveying unit, thus, various types of sheet processing including such as diversion and the like can be performed without changing the arrangement of the system, and the applicability of the system can be improved substantially.

What is claimed is:

1. In a sheet conveying device including a supplying unit for advancing a plurality of sheets in side-bay-side relation to each other along a supply path, and a conveying unit for receiving said sheets advanced by said supplying unit and conveying said sheets along another path extending in a lateral direction away from said supply path, the improvement comprising selective conveying means disposed between said supplying unit and said conveying unit for receiving and individually conveying said sheets from said supplying unit and including a plurality of independently operable sheet conveying means for receiving respectively associated sheets from said supplying unit and advancing said respectively associated sheets along generally parallel paths at the same level from said supplying unit to said conveying unit, and control means for operating a selected one of said independently operable sheet conveying means to advance a selected one of said sheets from said supplying unit to said conveying unit and for operating said conveying unit to advance said selected one of said sheets along said another path before operating said other of said independently operable sheet conveying means to convey said other of said sheets to said conveying unit and controlling the operational timing of said sheet conveying means and said conveying unit in response to a sheet conveying order determined ab a specified conveying sequence whereby the order of advancement of said sheets advanced along said another path by said conveying unit may be altered to satisfy a specified sequence.

2. A sheet conveying device according to claim 1 in which the supplying unit comprises a cutter unit for cutting a continuous sheet into said plurality of sheets arranged in side-by-side relation.

3. A sheet conveying device according to claim 1, wherein said control means is responsive to a sheet conveying sequence as determined by a designated predetermined sheet conveying condition.

4. A sheet conveying device according to claim 3, in which the sheet conveying condition applied to the control means comprises a conveying sequence based on an arrangement of a working unit following the conveying unit, a priority order condition in processing the sheet, and a divert indication condition for diverting a desired sheet out of the conveying path.

5. A sheet conveying device according to claim wherein said control means comprises means for controlling the operation of said respective sheet conveying means in the selective conveying means and said conveying unit in response to a sheet conveying order determined by a specified conveying sequence.

6. In a sheet conveying device including a supplying unit for advancing a plurality of sheets in unison and in side-by-side relation to each other along a supply path, and a conveying unit for receiving said sheets advanced by said supplying unit and conveying said sheets along another path extending in a lateral direction away from said supply path, the improvement comprising selective conveying means disposed at a terminal end of said supplying unit between said supplying unit and said conveying unit for receiving said sheets from said supplying unit and individually conveying said sheets from said supplying unit to said conveying unit and including a plurality of independently operable sheet conveying means for receiving respectively associated sheets from said supplying unit, and control means for operating a selected one of said independently operable sheet conveying means to advance a selected one of said sheets from said terminal end of said supplying unit to said conveying unit and for operating said conveying unit to advance said selected one of said sheets along said another path before operating another of said independently operable sheet conveying means to convey another of said sheets to said conveying unit whereby the order of advancement of said sheets by said conveying unit may be altered.

* * * * *